US008554649B1

(12) United States Patent
Kurabayashi et al.

(10) Patent No.: US 8,554,649 B1
(45) Date of Patent: Oct. 8, 2013

(54) MAINTENANCE-COST-AWARE BILLING FOR CLOUD SERVICES

(75) Inventors: Shuichi Kurabayashi, Fujisawa (JP); Naofumi Yoshida, Yokohama (JP); Kosuke Takano, Fujisawa (JP)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/576,383

(22) PCT Filed: Mar. 21, 2012

(86) PCT No.: PCT/US2012/029988

§ 371 (c)(1),
(2), (4) Date: Jul. 31, 2012

(51) Int. Cl.
*G06Q 30/04* (2012.01)

(52) U.S. Cl.
USPC ..... 705/34; 705/28; 705/26.51; 370/310; 718/1; 717/170; 713/182

(58) Field of Classification Search
USPC ..... 705/34, 28, 14.1, 26.51; 715/229; 717/170
See application file for complete search history.

(56) References Cited

U.S. PATENT DOCUMENTS

| | | | | |
|---|---|---|---|---|
| 8,032,618 | B2 * | 10/2011 | Criddle et al. | 709/221 |
| 2003/0005041 | A1 * | 1/2003 | Ullmann et al. | 709/203 |
| 2004/0186787 | A1 * | 9/2004 | Brown et al. | 705/26 |
| 2009/0164356 | A1 * | 6/2009 | Bakman | 705/34 |
| 2009/0300608 | A1 * | 12/2009 | Ferris et al. | 718/1 |
| 2010/0306377 | A1 * | 12/2010 | DeHaan et al. | 709/226 |
| 2011/0213686 | A1 * | 9/2011 | Ferris et al. | 705/34 |
| 2011/0296019 | A1 * | 12/2011 | Ferris et al. | 709/226 |

OTHER PUBLICATIONS

Elite Enterprise, a Thomas Reuters Business, "Upgrading your enterprise system; Does it make sense?", 2010, paragraphs 14-15.*
International Search and Written Opinion Report dated Jun. 28, 2012 as received in related application No. PCT/US2012/029988.
Ara Trembly, "Legacy Systems Have More Lives than a Cat", blogging on insurance networking.com (http://www.insurancenetworking.com/blogs/insurance_technology_legacy_systems_middleware_computers-27136-1.html) retrieved on Nov. 11, 2011.
"Cloud billing: The missing link for cloud providers" www.cgi.com/en/view/whitepaper/cloud, 2010.
McKinsey & Co., "Clearing the Air on Cloud Computing," Discussion Document, Mar. 2009, http://www.cloudmagazine.fr/dotclear/public/clearing_the_air_on_cloud_computing.pdf.
Seung Hwan Ryu, Fabio Casati, Halyard Skogsrud, Boualem Benatallah, and Régis Saint-Paul. 2008. Supporting the dynamic evolution of Web service protocols in service-oriented architectures. ACM Trans. Web 2, 2, Article 13 (May 2008), 46 pages, http://doi.acm.org/10.1145/1346237.1346241.
Piotr Kaminski, Hausi Müller, and Marin Litoiu. 2006. A design for adaptive web service evolution. In Proceedings of the 2006 international workshop on Self-adaptation and self-managing systems (SEAMS '06). ACM, New York, NY, USA, 86-92. DOI=10.1145/1137677.1137694 http://doi.acm.org/10.1145/1137677.1137694.
Elite Enterprise, a Thomas Reuters business, "Upgrading your enterprise system: Does it make sense?", 2010, p. 1, paragraphs 14-15.

* cited by examiner

*Primary Examiner* — Vanel Frenel
(74) *Attorney, Agent, or Firm* — Maschoff Brennan

(57) ABSTRACT

In some examples, a method for performing maintenance-cost-aware billing is described. The method may include generating a version of a virtual machine image. The method may also include calculating a usage charge for usage of an instantiated virtual machine corresponding to the version of the virtual machine image. The calculation of the usage charge may be based on an age of the version of the virtual machine image.

20 Claims, 5 Drawing Sheets

MAINTENANCE-COST-AWARE BILLING FOR CLOUD SERVICES

BACKGROUND

Unless otherwise indicated herein, the materials described herein are not prior art to the claims in the present application and are not admitted to be prior art by inclusion in this section.

Cloud computing environments may include software-as-a-service (SaaS) and platform-as-a-service (PaaS) environments. SaaS may provide a user with access to an application software package that may include, but is not limited to, e-mail, groupware, customer relationship management (CRM), and the like. PaaS may provide users with a computing platform on which user-specific applications may be deployed and executed.

When a SaaS environment is updated, business flows that users have constructed on the SaaS environment may have to be migrated to function properly in the updated SaaS environment, which may include one or more updated calling protocols, parameters, and/or Application Programming Interfaces (APIs). Analogously, when a PaaS environment is updated, user-deployed applications may have to be migrated to function properly in the updated PaaS environment, which may include updated middleware. Updates to SaaS/PaaS environments in some cases may be unavoidable, such as in response to discovering a security hole or for load distribution. Migration may be disruptive and/or costly for users.

In some cases, users who wish to continue using a specific version of a SaaS/PaaS environment and users who wish to use a latest version may coexist in a given cloud computing environment. As such, it is difficult to update the cloud computing environment all at once. Moreover, maintenance costs to maintain increasingly older versions of SaaS/PaaS environments typically increase with increasing age.

SUMMARY

Technologies described herein generally relate to maintenance-cost-aware billing for cloud computing environments.

In some examples, a method for performing maintenance-cost-aware billing is described. The method may include generating a version of a virtual machine image. The method may also include calculating a usage charge for usage of an instantiated virtual machine corresponding to the version of the virtual machine image. The calculation of the usage charge may be based on an age of the version of the virtual machine image.

In some examples, a computer storage medium having computer-executable instructions stored thereon that are executable by a computing device to perform operations is described. The operations may include generating a version of a virtual machine image. The operations may also include calculating a usage charge for usage of an instantiated virtual machine corresponding to the version of the virtual machine image. The calculation of the usage charge may be based on an age of the version of the virtual machine image.

In some examples, a back end system of a cloud service is described. The back end system may include a version controller and a billing module. The version controller may be configured to generate multiple versions of multiple virtual machine images. The billing module may be configured to calculate multiple usage charges for usage of multiple instantiated virtual machines corresponding to the versions of the virtual machine images. A calculation of each of the usage charges may be based on an age of a corresponding version of a corresponding virtual machine image.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
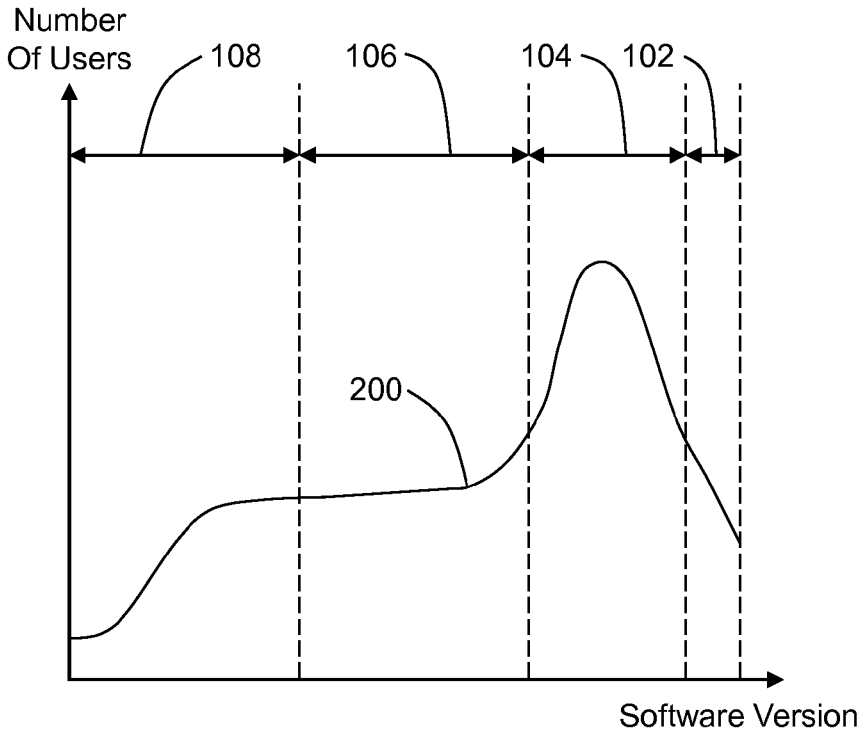
FIG. 1 is a graph illustrating an example relationship between number of users and software versions in a cloud service.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Some embodiments described herein generally relate to a maintenance-cost-aware billing model for cloud computing environments. Software constituting a software-as-a-service (SaaS) or platform-as-a-service (PaaS) environment may be versioned using virtual machine images (VMIs). Usage charges may be calculated based on the age of a given VMI. For instance, as a version of a VMI ages over the course of a maintenance period specified in an associated contract, usage charges for using a corresponding instantiated virtual machine may progressively increase from a lower value at the beginning of the maintenance period to a higher value at the end of the maintenance period. The increase in usage charges may be sufficient in some cases to partially or completely offset maintenances costs involved in maintaining the version of the VMI, and/or may be sufficient to make maintaining the version of the VMI profitable.

Accordingly, in some embodiments described herein, a cloud service provider can maintain older versions of SaaS and/or PaaS environments for users that desire to continue using a given version, without unfairly apportioning the growing cost of maintaining progressively older versions amongst users that prefer to use newer versions, and without maintaining the progressively older versions at a financial loss. At the same time, embodiments of the maintenance-cost-aware billing described herein may attract floating users, e.g., users that can easily migrate between software versions, by charging lower usage charges to users of the latest and/or newer versions.

FIG. 1 is a graph illustrating an example relationship between number of users and software versions in a cloud service (not shown), arranged in accordance with at least some embodiments described herein. In particular, the graph shown in FIG. 1 includes a curve 100 representing number of users as a function of software version being used by each of the number of users. The example relationship illustrated in FIG. 1 suggests a tendency among users of certain software in which a relatively small number of early adopters use a latest version(s) 102 of the software, a greater number of users use a relatively new version(s) 104 of the software that may be more stable than the latest version(s) 102, a relatively small number of locked-in users continue using an older version(s) 106 of the software, and a relatively smaller number of deeply locked-in users continue using an oldest version(s) 108 of the software.

The cost to maintain a particular version of software in the cloud service may increase with increasing age of the software version. Thus, it may be unfair to early adopters of the latest version(s) 102, users of the relatively new version(s) 104, and/or locked-in users of the older versions 106 to equally distribute costs associated with maintaining all versions 102, 104, 106, 108 of the software. Accordingly, some embodiments described herein may charge increasingly higher usage charges for using increasingly older software versions, referred to herein as maintenance-cost-aware billing. For example, the users of the relatively new version(s) 104 of the software may be charged more than the early adopters of the latest version(s) 102 of the software. Similarly, the locked-in users of the older version(s) 106 of the software may be charged more than the users of the relatively new version(s) 104 of the software. Similarly, the deeply locked-in users of the oldest version(s) 108 of the software may be charged more than the locked-in users of the older version(s) 106 of the software.

Embodiments of maintenance-cost-aware billing may more fairly distribute maintenance costs amongst the users of the software versions 102, 104, 106, 108 since users of older versions of the software, which have relatively higher maintenance costs, may be charged more than users of newer versions of the software. Moreover, since usage charges may be increasingly lower for increasingly newer software versions, embodiments of maintenance-cost-aware billing may incentivize users to migrate to the latest version 102 of the software. As such, the number of users of the latest version(s) 102 may increase. As the number of users of the latest version(s) 102 increases, security holes, bugs, and/or other problems may be discovered earlier, and may then be resolved earlier than might otherwise occur, potentially leading to a shorter time to development of a relatively more secure and stable latest version(s) 102, e.g., a latest version(s) with relatively fewer security holes, bugs, and/or other problems. Shorter time to security and/or stability of the latest version(s) 102 of software may additionally attract floating users, e.g., users who can readily and easily migrate between software versions.

Figure 2:
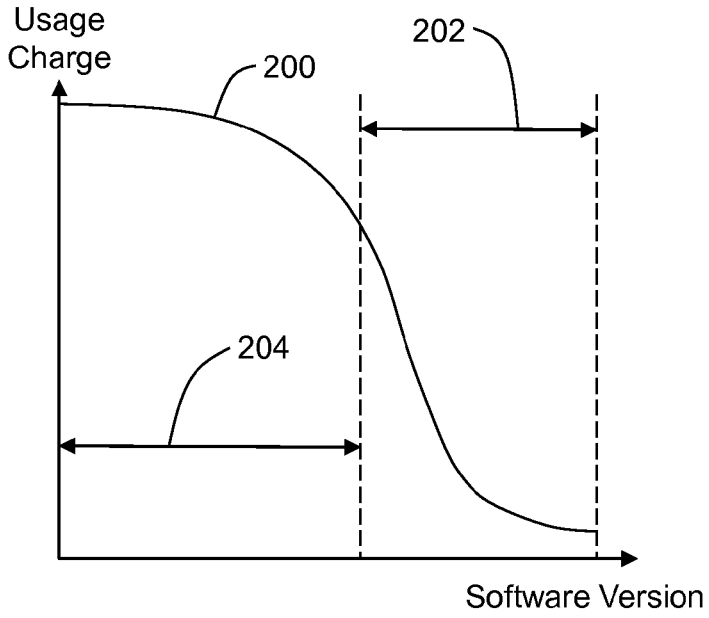
FIG. 2 is a graph illustrating an example maintenance-cost-aware billing relationship between usage charges and software versions.

FIG. 2 is a graph illustrating an example maintenance-cost-aware billing relationship between usage charges and software versions, arranged in accordance with at least some embodiments described herein. In particular, FIG. 2 shows a curve 200 representing usage charge as a function of software version. In FIG. 2, the software version may increase to the right, meaning age may increase to the left. As illustrated, usage charges may be relatively low for the latest, or highest, version of software, and may increase with increasing age. The curve 200 of FIG. 2 is only one example of a maintenance-cost-aware billing relationship between usage charges and software versions. Embodiments of maintenance-cost-aware billing may more generally include virtually any relationship in which usage charges increase with increasing software version age.

FIG. 2 additionally illustrates two example maintenance periods 202, 204, also referred to as product lifetimes. The maintenance period 202 may be suitable for users who are willing to periodically migrate to a particular version of software that is relatively new at the time of migration, but who also desire to continue using the particular version throughout the maintenance period 202 to avoid frequent migration and its associated difficulties. By periodically migrating to a particular version that is relatively new at the time of migration, usage charges may be reduced at the beginning of each maintenance period 202, followed by increasing usage charges as the particular version ages until reaching the end of each maintenance period 202.

The maintenance period 204 may be suitable for users that are unwilling to migrate as frequently as the users opting for the maintenance period 202, and/or for users that are unwilling to migrate to a version of software that is so new that it may not be completely secure and/or stable. These users may also see a reduction in usage charges at the beginning of each maintenance period 204 as they migrate to a version of software that is newer than what they were using previously, but is already somewhat old, followed by an increase in usage charges with increasing age of the version of software. The maintenance periods 202, 204 are provided by way of example only, and should not be construed to limit the embodiments described herein.

Figure 3:
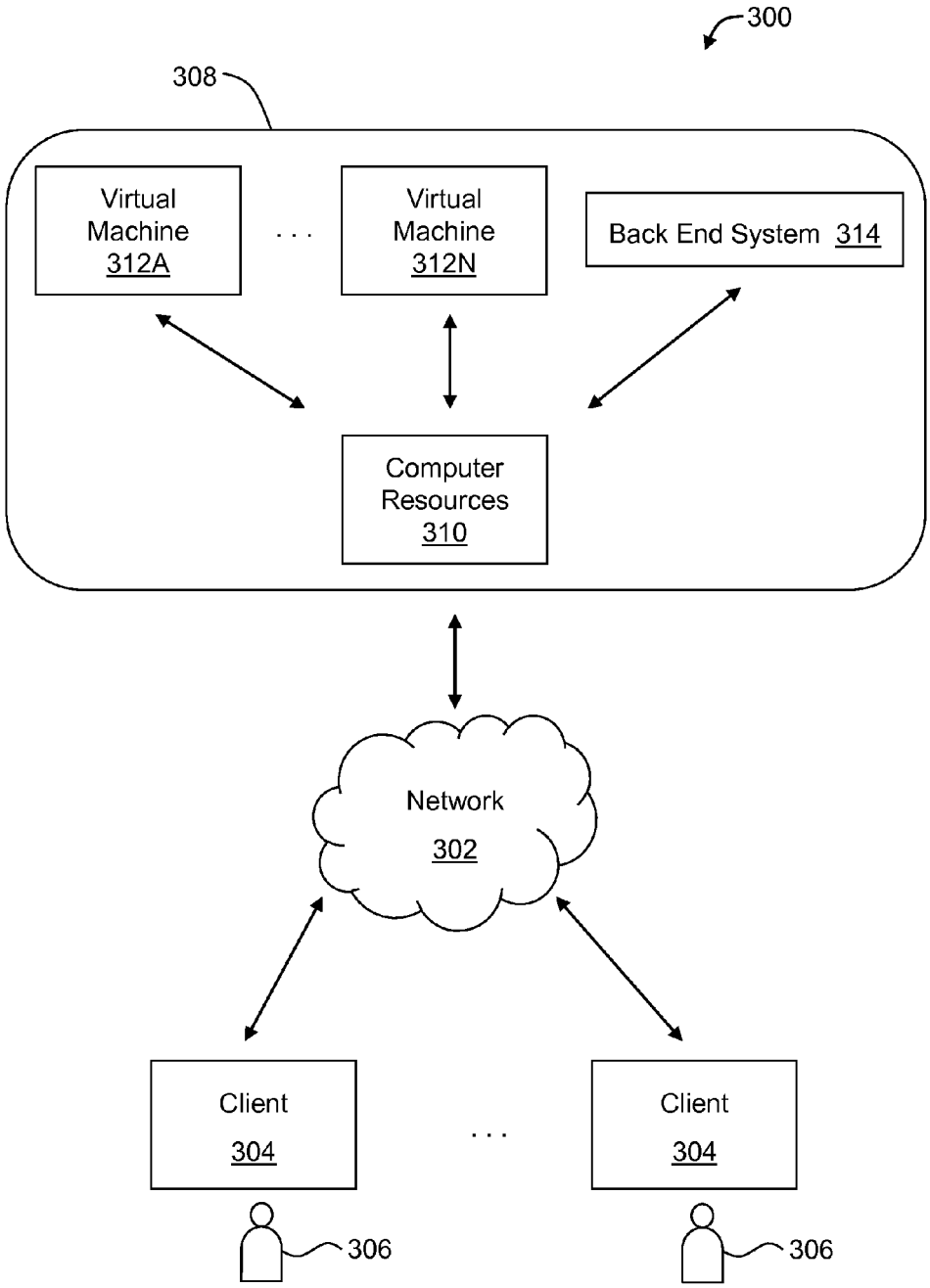
FIG. 3 is a block diagram of an example cloud computing environment in which embodiments of maintenance-cost-aware billing may be implemented.

FIG. 3 is a block diagram of an example cloud computing environment 300 in which embodiments of maintenance-cost-aware billing may be implemented, arranged in accordance with at least some embodiments described herein. In the illustrated embodiment, the cloud computing environment 300 includes a network 302, one or more client devices 304 and corresponding users 306, and a cloud service 308.

In general, the network 302 may include one or more wide area networks (WANs) and/or local area networks (LANs) that enable the client devices 304 and the cloud service 308 to communicate with each other. In some embodiments, the network 302 includes the Internet, including a global internetwork formed by logical and physical connections between multiple WANs and/or LANs. Alternately or additionally, the network 302 may include one or more cellular RF networks and/or one or more wired and/or wireless networks such as, but not limited to, 802.xx networks, Bluetooth access points, wireless access points, IP-based networks, or the like. The network 302 may also include servers that enable one type of network to interface with another type of network.

Each of the client devices 304 may execute an application (not shown) or other instructions configured to communicate through the network 302 with the cloud service 308. The application executed on each client device 308 to communicate with the cloud service 308 may include an internet browser, or other suitable application. Each of the client devices 304 may include, but is not limited to, a desktop computer, a laptop computer, a mobile phone, a smartphone, a personal digital assistant (PDA), or other suitable client device.

The cloud service 308 of the cloud computing environment 300 may include computer resources 310, one or more virtual machines 312A-312N that are accessible to the users 306, and a back end system 314. Although not required, the cloud service 308 may include an AMAZON EC2-type cloud service.

By way of example, and not limitation, the computer resources 310 may include processing resources such as one or more central processing units (CPUs), storage resources such as one or more storage devices, other resources such as network interface controllers (NICs) or other communication interface devices, and/or other suitable computer resources.

Each of the virtual machines 312A-312N may be associated with a corresponding one of the users 306. The users 306 may broadly include individual users and/or organizations including one or more users. In general, the users 306 may operate the client devices 304 to access the virtual machines 312A-312N running on the computer resources 310.

In some embodiments, the virtual machines 312A-312N, or more particularly, corresponding VMIs, may be versioned and the cloud service 308 may implement maintenance-cost-aware billing such that usage charges, e.g., fees that are charged to the users 306, may be based on the age, e.g., the version, of the virtual machine(s) 312A-312N associated with each user 306. The virtual machines 312A-312N may be versioned in some embodiments by versioning software constituting a particular software-as-a-service (SaaS) or platform-as-a-service (PaaS) environment within the virtual machines 312 and/or by versioning corresponding virtualization software.

According to some embodiments, the usage charges may be higher for usage of older versions of the virtual machines 312A-312N, and lower for usage of newer versions of the virtual machines 312. Moreover, the usage charges over time for using a given version of any one of the virtual machines 312A-312N may increase as the virtual machine 312A-312N ages. For example, the usage charges may be calculated according to a graph, such as the graph of FIG. 2, and/or according to a function in which usage charges increase with increasing age of the software. Accordingly, some embodiments described herein may incentivize users to migrate to newer versions of the virtual machines 312A-312N, and/or may partially or completely offset the cost of maintaining aging versions of the virtual machines 312A-312N, or may make such maintenance profitable.

As will be described in greater detail in the discussion of FIG. 4, the back end system 314 may be configured to, among other things, generate versions of the virtual machines 312A-312N, or more particularly may generate versions of the corresponding VMIs, according to contracts with the users 306 of the versions of the virtual machines 312A-312N and/or according to contracts that are otherwise associated with the versions of the virtual machines 312A-312N. The back end system 314 may also be configured to calculate usage charges for usage of the versions of the virtual machines 312A-312N based on the age of each version.

Figure 4:
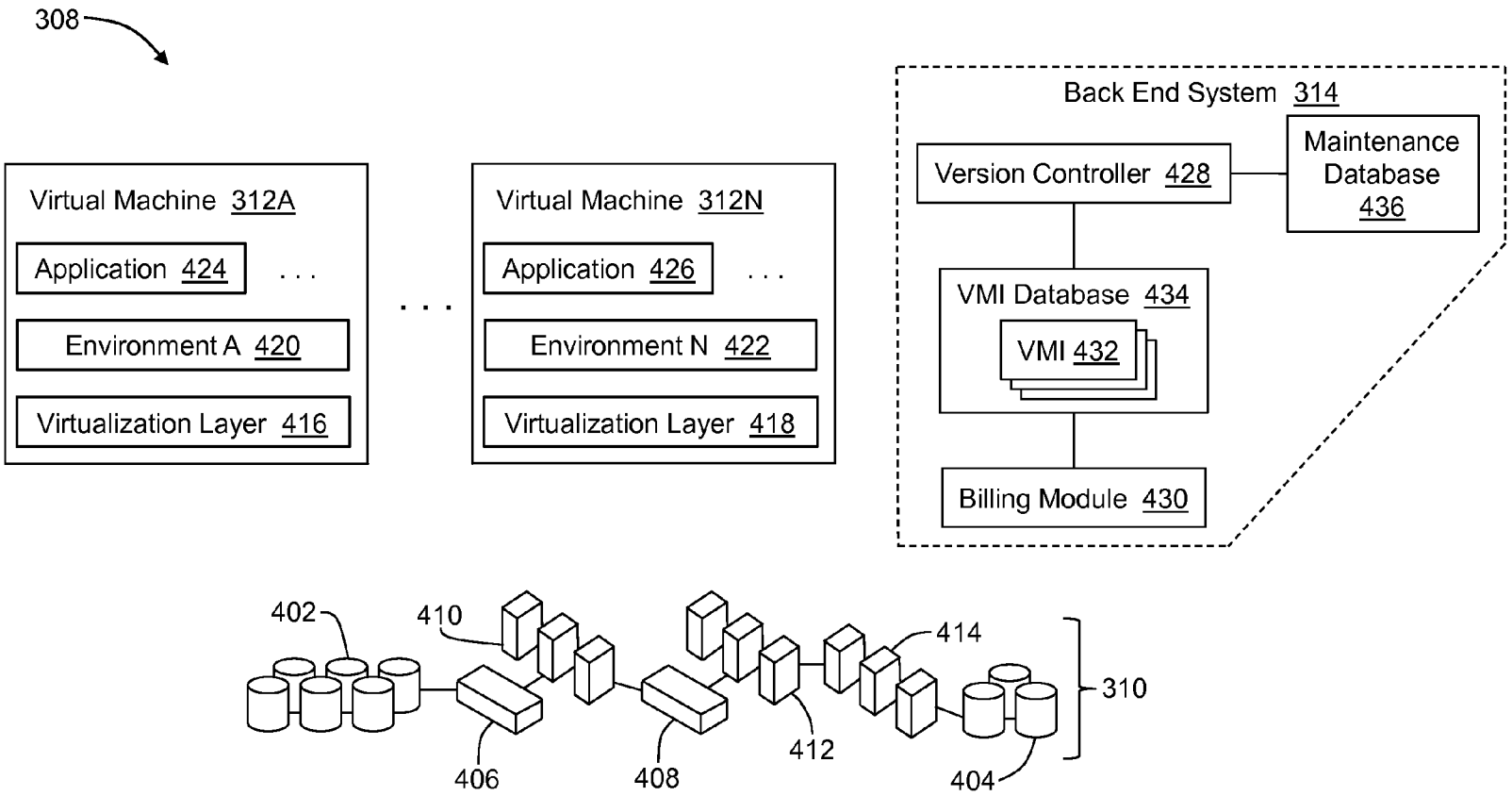
FIG. 4 is a block diagram of an example embodiment of a cloud service of FIG. 3.

FIG. 4 is a block diagram of an example embodiment of the cloud service 308 of FIG. 3, arranged in accordance with at least some embodiments described herein. As illustrated in FIG. 4, the computer resources 310 of the cloud service 308 may include storage devices 402, 404, networks and/or network devices 406, 408, and physical servers 410, 412, 414 or other computing devices.

The storage devices 402, 404 may be implemented as primary storage within the computer resources 310 and may include nearly any type of storage device for digital data such as Random Access Memory (RAM), Read Only Memory (ROM), Electrically Erasable Programmable ROM (EEPROM), Compact Disc-ROM (CD-ROM) or other optical disk storage, magnetic disk storage, solid state storage or other storage devices.

The networks and/or network devices 406, 408 may include one or more switches, routers, communication interfaces and/or other devices for facilitating communication between devices in the computer resources 310.

The physical servers 410, 412, 414 may each include one or more CPUs and/or local storage devices.

A virtualization layer 416, 418 may be provided in each virtual machine 312A-312N to manage access to or "virtualize" the computer resources 310 for the virtual machine 312A-312N. Examples of virtualization layers 416, 418 may include, but are not limited to, VMware ESX, VMware GSX, Xen 3.0 (or other versions), or KVM, or other suitable virtualization layers.

Each virtual machine 312A-312N may additionally include a particular SaaS or PaaS environment 420, 422 (hereinafter individually "environment A 420" and "environment N 422," or collectively "environments A/N 420, 422"). Each of the environments A/N 420, 422 may include any one of potentially multiple versions of software, such as an operating system, or the like, running on standardized hardware presented to the virtual machine 312A-312N by the corresponding virtualization layer 416, 418. Alternately or additionally, each of the virtualization layers 416, 418 may include any one of potentially multiple versions of the corresponding virtualization layer 416, 418. A given version of the environment A/N 420 or 422 and/or a given version of the corresponding virtualization layer 416 or 418 may constitute a given version of a corresponding VMI.

Each virtual machine 312A-312N may additionally include one or more applications 424, 426 configured to run in the corresponding environment A/N 420, 422. In some embodiments, when the environment A 420 or environment N 422 includes a SaaS environment, the one or more applications 424 or 426 in the corresponding virtual machine 312A-312N may be deployed by a provider associated with the cloud service 308. Alternately or additionally, when the environment A 420 or environment N 422 includes a PaaS environment, the one or more applications 424 or 426 in the corresponding virtual machine 312A-312N may be deployed by a corresponding one of the users 306 of FIG. 3, for example.

The back end system 314 includes one or more components that may be implemented in hardware and/or software in and/or on the computer resources 310. For example, the back end system 314 may include a version controller 428 and a billing module 430.

The version controller 428 may be configured to generate versions of VMIs 432 corresponding to the instantiated virtual machines 312A-312N. In general, each VMI 432 may include binary code that, when executed by a processing device such as by a processing device of any of the physical servers 410, 412, 414, causes a corresponding one of the virtual machines 312A-312N to instantiate. The version controller 428 may be configured to generate a given version of a VMI 432 as directed by a corresponding one of the users 306 and/or in accordance with a contract associated with the user.

The billing module 430 may be configured to calculate usage charges for the instantiated virtual machines 312A-312N corresponding to the versions of the VMIs 432. A calculation of each of the usage charges may be based on an age of a corresponding version of a corresponding one of the VMIs 432, where usage charges for usage of older versions are generally higher than usage chargers for usage of younger versions of the same VMI 432. For instance, the billing module 430 may be configured to calculate usage charges according to a graph, such as the graph of FIG. 2, and/or according to a function in which usage charges increase with increasing age of the VMI 432.

Each of the version controller 428 and the billing module 430 may include computer-executable instructions stored in a computer-readable medium, the computer-executable instructions being executable by a processing device, such as a processing device of any of the physical servers 410, 412, 414, to perform one or more of the operations described herein. Alternately or additionally, one or both of the version controller 428 or the billing module 430 may be implemented in hardware.

As illustrated in FIG. 4, the back end system 314 may further include a VMI database 434 and/or a maintenance database 436. The VMI database 434 may be configured to store each of the versions of the VMIs 432 according to a corresponding maintenance period specified by a corresponding contract associated with a corresponding one of the VMIs 432, such as a corresponding contract associated with a corresponding one of the users 306 of FIG. 3.

The maintenance database 436 may be configured to store maintenance periods corresponding to the versions of the VMIs 432 stored in the VMI database 434. A timestamp, a VMI 432 version number, or the like may be stored in the maintenance database 436 to designate the beginning of a maintenance period for a given contract, and the contract or data derived therefrom may also be stored in the maintenance database to specify the duration of the maintenance period. The duration may be defined in terms of time, such as in terms of a number of days, months, and/or years, and/or in terms of maintenance cycles, such as in terms of a number of security patches and/or hot fixes.

In general, a given version of a corresponding one of the VMIs 432 may be maintained for the duration of the maintenance period specified in a corresponding contract, at the end of which maintenance period the given version of the VMI 432 may be migrated to a newer version of the VMI 432. The contract may additionally specify whether the newer version of the VMI 432 to which migration occurs at the end of the maintenance period is a latest version of the VMI 432, or a non-latest version of the VMI 432 that may be more secure and/or stable than the latest version of the VMI 432.

In operation, the version controller 428 may be configured to migrate each VMI 432 to a newer version of a corresponding one of the VMIs 432 according to a corresponding contract by, for each VMI 432, determining from the maintenance database 436 when the corresponding maintenance period will expire. A particular newer version of the corresponding VMI 432 may be determined, also from the maintenance database 436 and/or the corresponding contract, to which the VMI 432 will be migrated at the end of the corresponding maintenance period. The newer version may be generated by the version controller 428 and stored in the VMI database 434. The version controller 428 may determine that the corresponding maintenance period has expired and may initiate a corresponding new maintenance period. For example, the old timestamp, VMI 432 version number, or the like in the maintenance database 436 may be replaced by a new timestamp, VMI 432 version number, or the like to designate the beginning of the new maintenance period. The version controller 428 may then migrate the VMI 432 to the particular newer version of the corresponding VMI 432.

As indicated previously, the particular newer version of the corresponding VMI 432 may include, in some embodiments, a latest version of the corresponding VMI 432, in which case a first usage charge calculated at a beginning of the corresponding new maintenance period may have a first value that is relatively low. Alternately, the particular newer version of the corresponding VMI 432 may include a non-latest version of the corresponding VMI 432 such that the first usage charge calculated at the beginning of the corresponding new maintenance period may have a second value that is higher than the first value.

Figure 5:
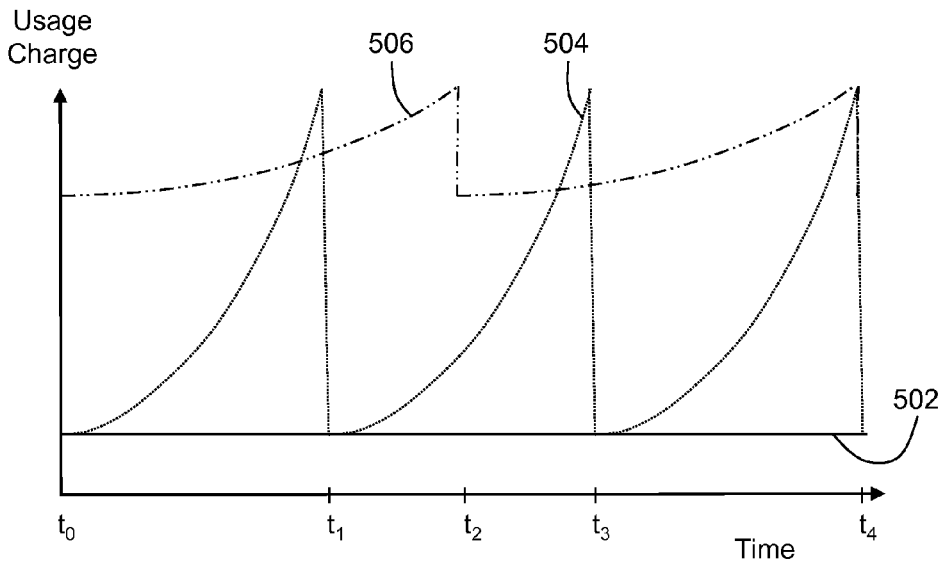
FIG. 5 is a graph illustrative various example usage models that may be implemented in the cloud service of FIG. 3.

FIG. 5 is a graph illustrating various example usage models that may be implemented in the cloud service 308 of FIG. 3, arranged in accordance with at least some embodiments described herein. In particular, FIG. 5 shows three usage models 502, 504, 506 representing usage charges over time for three different maintenance periods which may be specified in corresponding contracts. The usage models 502, 504, 506 may be calculated in some embodiments according to a graph or function in which usage charges increase with increasing age of a corresponding VMI, such as according to the graph of FIG. 2.

The first usage model 502 may correspond to a maintenance period of zero in which a corresponding user migrates to the latest version of a corresponding VMI immediately and/or soon after the latest version is released. The first usage model 502 may be suitable for, e.g., developers and/or floating users. Because the user in the first usage model 502 migrates to the latest version immediately or soon after release of the latest version, and because usages charges for usage of the latest version may be lower than usage charges for usage of any non-latest versions, the usage charges over time under the first usage model 502 may remain steady and low for the user.

The second usage model 504 may correspond to a maintenance period of one year in which a corresponding user migrates to the latest version of a corresponding VMI once per year. The second usage model 504 may be suitable for the average business user, for example. In FIG. 5, time $t_0$ may represent an initial time, time $t_1$ may represent one year from time $t_0$, time $t_3$ may represent one year from time $t_1$, and time $t_4$ may represent one year from time $t_3$. Thus, the ranges $t_0$-$t_1$, $t_1$-$t_3$ and $t_3$-$t_4$ may correspond to one-year maintenance periods of the second usage model 504.

As illustrated in FIG. 5, the usage charges of each maintenance period $t_0$-$t_1$, $t_1$-$t_3$ and $t_3$-$t_4$ of the second usage model 504 are the lowest at the beginning of each maintenance period $t_0$-$t_1$, $t_1$-$t_3$ and $t_3$-$t_4$ after migrating to (or beginning with) the latest version of the corresponding VMI. As the corresponding version of the VMI ages during each maintenance period $t_0$-$t_1$, $t_1$-$t_3$ and $t_3$-$t_4$, however, the usage charges increase until the end of the maintenance period $t_0$-$t_1$, $t_1$-$t_3$ and $t_3$-$t_4$ when the usage charges are at their highest, followed by a drastic decrease at the beginning of the next maintenance period $t_0$-$t_1$, $t_1$-$t_3$ and $t_3$-$t_4$ after migrating again to a latest version.

The third usage model 506 may correspond to a maintenance period of one-and-a-half years in which a corresponding user migrates to a relatively newer non-latest version of a corresponding VMI once every year-and-a-half. The third usage model 506 may be suitable for relatively conservative users who desire a relatively secure and/or stable SaaS/PaaS environment. In FIG. 5, time $t_2$ may represent one-and-a-half years from time $t_0$, and time $t_4$ may represent one-and-a-half years from time $t_2$. Thus, the ranges $t_0$-$t_2$ and $t_2$-$t_4$ may correspond to one-and-a-half year maintenance periods of the third usage model 506.

As illustrated in FIG. 5, the usage charges of each maintenance period $t_0$-$t_2$ and $t_2$-$t_4$ of the third usage model 506 are the lowest at the beginning of each maintenance period $t_0$-$t_2$ and $t_2$-$t_4$ after migrating to (or beginning with) the relatively newer non-latest version of the corresponding VMI. As the corresponding version of the VMI ages during each maintenance period $t_0$-$t_2$ and $t_{244}$, however, the usage charges increase until the end of the maintenance period $t_0$-$t_2$ and $t_2$-$t_4$ when the usage charges are at their highest, followed by a decrease at the beginning of the next maintenance period $t_0$-$t_2$ and $t_2$-$t_4$ after migrating again to a relatively newer non-latest version.

Figure 6:
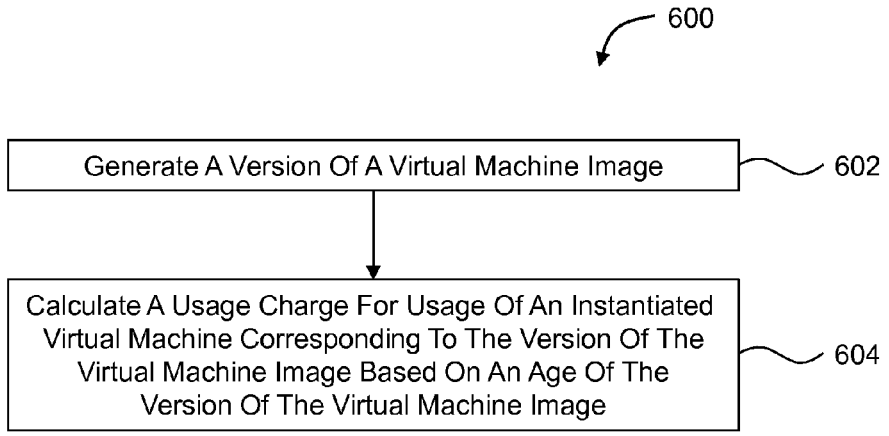
FIG. 6 shows an example flow diagram of a method for performing maintenance-cost-aware billing.

FIG. 6 shows an example flow diagram of a method 600 for performing maintenance-cost-aware billing, arranged in accordance with at least some embodiments described herein. The method 600 may be performed in whole or in part by, e.g., the back end system 314 of FIGS. 3-4. The method 600 includes various operations, functions or actions as illustrated by one or more of blocks 602 and/or 604. The method 600 may begin at block 602.

In block 602 ("Generate A Version Of A Virtual Machine Image"), a version of a VMI is generated. For example, the version controller 428 of the back end system 314 may generate the version of the VMI by capturing a snapshot of the corresponding VMI and storing the version of the VMI in the VMI database 434. The version of the VMI may be generated as requested by a corresponding user.

Alternately or additionally, the version of the VMI may be generated in accordance with a contract associated with the VMI. For example, if the contract specifies migration to a particular version, e.g., latest or non-latest, the version of the VMI may be automatically generated at the beginning of a new corresponding maintenance period or at the end of a corresponding current maintenance period, or the like. Block 602 may be followed by block 604.

In block 604 ("Calculate A Usage Charge For Usage Of An Instantiated Virtual Machine Corresponding To The Version Of The Virtual Machine Image Based On An Age Of The Version Of The Virtual Machine Image"), a usage charge is calculated for usage of an instantiated virtual machine corresponding to the version of the VMI based on an age of the version of the VMI. The usage charge may be calculated according to a function or graph in which a greater age corresponds to a higher usage charge. For instance, the graph may include the graph of FIG. 2. Alternately or additionally, the function or graph may be configured to incentivize early migration to a latest version of the VMI by, e.g., charging less for usage of the latest version than for usage of older versions.

Alternately or additionally, the usage charge may be calculated according to an arc tangent function generally of the form $f(x)=A\cdot\arctan(x-B)+\pi(A/2)$. In this and other embodiments, $f(x)$ is the calculated usage charge in a range including a minimum charge $C_{min}\leq f(x)\leq$a maximum charge $C_{max}$, x is the age of the version of the VMI in a domain including a minimum age $x_{min}\leq x\leq$a maximum age $x_{max}$, and A and B are constants such that $f(x_{min})=C_{min}$ and $f(x_{max})=C_{max}$.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

For example, the method 600 may further include calculating, over the course of a maintenance period of the VMI specified in a contract associated with the VMI, multiple usage charges for the instantiated virtual machine corresponding to the version of the VMI, wherein each of the usage charges is based on a corresponding age of the version of the VMI. The usage charges may be configured to be sufficient to completely offset maintenance costs associated with maintaining the version of the VMI over the course of the maintenance period. Alternately or additionally, the usage charges may be further configured to be sufficiently large that maintaining the version of the VMI according to the specified maintenance period is profitable.

In some embodiments, the method 600 may further include maintaining the VMI over the course of the maintenance period.

Alternately or additionally, the method 600 may further include iterating as follows. A current version of a VMI may be automatically migrated to a newer version of the VMI at an end of a current maintenance period. A new maintenance period may be initiated. Over the course of the new maintenance period, multiple usage charges may be calculated for usage of an instantiated virtual machine corresponding to the newer version of the VMI, where each of the usage charges may be based on a corresponding age of the newer version of the VMI.

In these and other embodiments, a given newer version of the VMI image may include a latest version of the VMI, and a first usage charge calculated at the beginning of a corresponding new maintenance period may have a first value that is relatively low. For instance, the second usage model 504 of FIG. 5 provides an example in which the newer version at the beginning of each maintenance period is the latest version and the first usage charge at the beginning of each maintenance period is relatively low. In the foregoing example, it is understood that the newer version of the VMI image may only qualify as the latest version for a portion, e.g., the beginning, of the corresponding new maintenance period until another latest version is released.

Alternately, the given newer version of the VMI image may include a non-latest version of the VMI image such that the first usage charge calculated at the beginning of the corresponding new maintenance period has a second value that is higher than the first value. For instance, the third usage model 506 of FIG. 5 provides an example in which the newer version at the beginning of each maintenance period is a non-latest version and the first usage charge at the beginning of each maintenance period is a second value that is higher than first value for the latest version at the beginning of each maintenance period for the second usage model 504.

Some embodiments disclosed herein include a computer storage medium having computer-executable instructions stored thereon that are executable by a computing device to perform operations included in the method 600 of FIG. 6, such as the operations illustrated by blocks 602 and/or 604 in FIG. 6, and/or variations thereof. The computer storage medium may be included in one or more of the storage devices 402, 404 of FIG. 4 and/or in one or more local storage devices of the physical servers 410, 412, 414 of FIG. 4.

Accordingly, some embodiments of maintenance-cost-aware billing described herein charge users increasingly more for using increasingly older versions of software. As such, usage of the latest version of software may be the least expensive which may attract floating users who can readily perform migration. Alternately or additionally, users may be incentivized to migrate to the latest version of software, which may lead to more users migrating to the latest version earlier than would otherwise occur, which in turn may ultimately lead to a latest version that is more secure and/or more stable earlier than would otherwise occur.

Some of the disclosed embodiments may provide a pricing model that is fair to both users who wish to continue using a specific version of software and to users who wish to periodically and/or constantly migrate to a newer version. In particular, users who wish to continue using a specific version of software can pay increasingly higher usage charges to offset increasingly higher maintenance costs as the specific version of software ages.

In some embodiments, the increasing usages charges for usage of increasingly older versions of software may be sufficient to at least partially or completely offset maintenance costs associated with maintaining the increasingly older versions of software throughout corresponding maintenance periods. Alternately or additionally, the increasing usage charges for usage of increasingly older versions of software may be sufficient to make maintaining the increasingly older versions of software through corresponding maintenance periods profitable.

Figure 7:
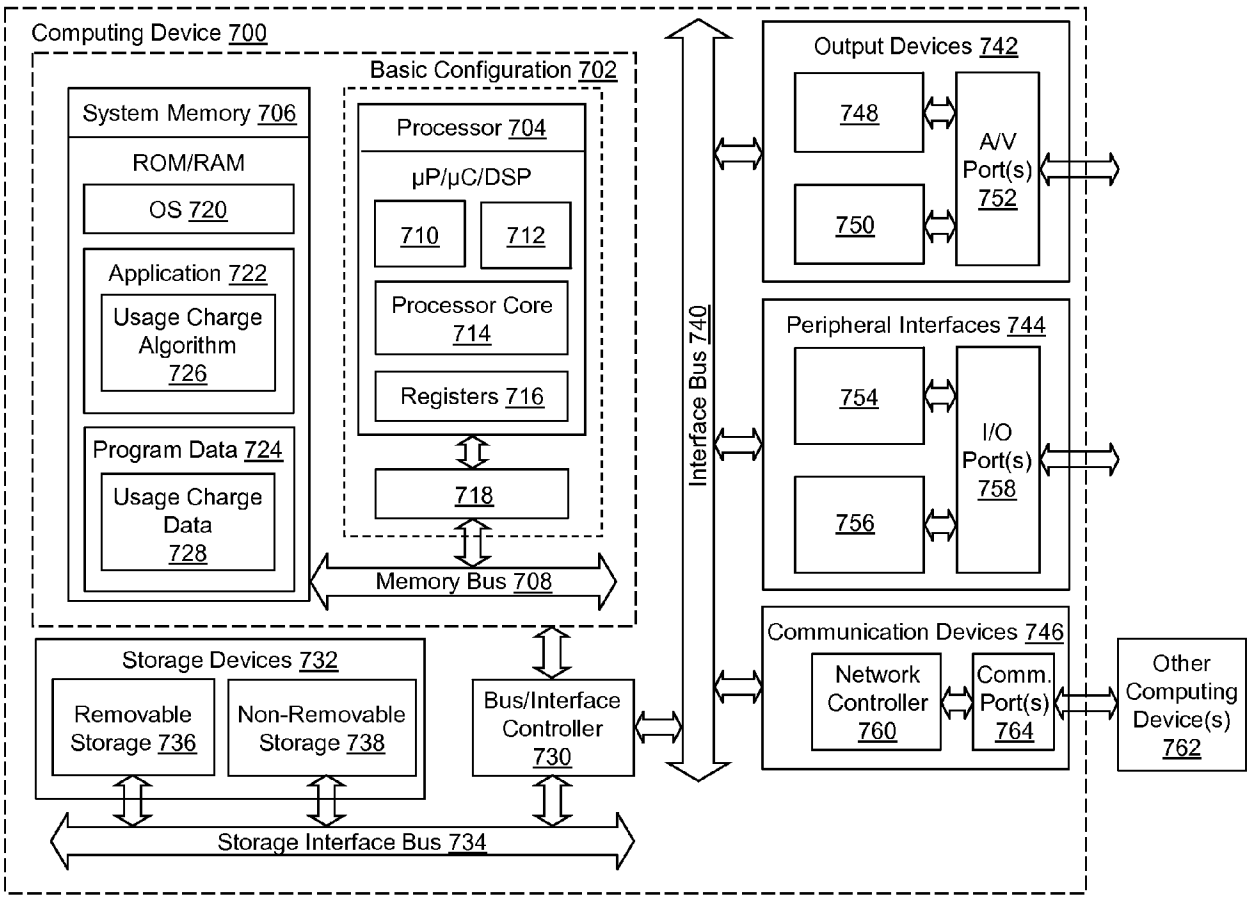
FIG. 7 is a block diagram illustrating an example computing device that is arranged for maintenance-cost-aware billing, all arranged in accordance with at least some embodiments described herein.
Figure 1:
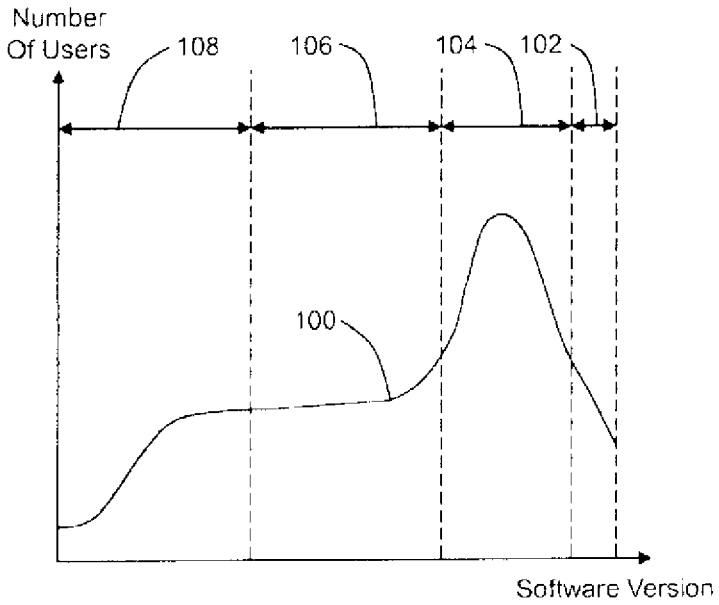
Figure 2:
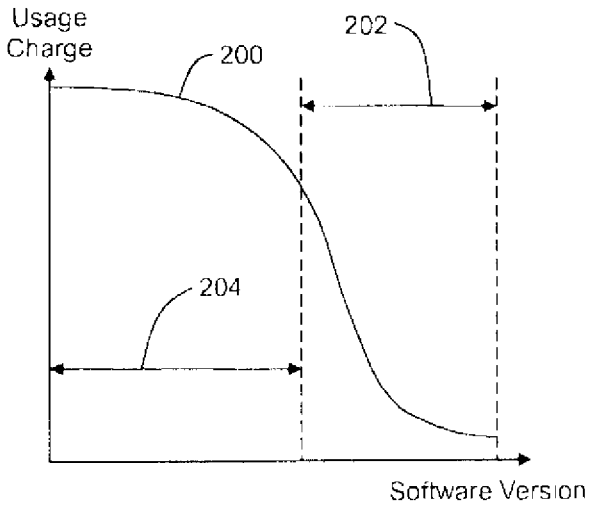

FIG. 7 is a block diagram illustrating an example computing device 700 that is arranged for maintenance-cost-aware billing, arranged in accordance with at least some embodiments described herein. The computing device 700 may be included in the computer resources 310 of FIGS. 3 and 4, for example. In a very basic configuration 702, the computing device 700 typically includes one or more processors 704 and a system memory 706. A memory bus 708 may be used for communicating between the processor 704 and the system memory 706.

Depending on the desired configuration, the processor 704 may be of any type including but not limited to a microprocessor (μP), a microcontroller (μC), a digital signal processor (DSP), or any combination thereof. The processor 704 may include one more levels of caching, such as a level one cache 710 and a level two cache 712, a processor core 714, and registers 716. An example processor core 714 may include an arithmetic logic unit (ALU), a floating point unit (FPU), a digital signal processing core (DSP Core), or any combination thereof. An example memory controller 718 may also be used with the processor 704, or in some implementations the memory controller 718 may be an internal part of the processor 704.

Depending on the desired configuration, the system memory 706 may be of any type including but not limited to volatile memory (such as RAM), non-volatile memory (such as ROM, flash memory, etc.) or any combination thereof. The system memory 706 may include an OS 720, one or more applications 722, and program data 724. The application 722 may include a usage charge algorithm 726 that is arranged to perform the functions as described herein including those described with respect to the method 600 of FIG. 6. The application 722 may correspond to one or more of the version controller 428 and/or billing module 430 of FIG. 4, for example. The program data 724 may include usage charge data 728 that may be useful for configuring the usage charge algorithm 726 as is described herein. For instance, the usage charge data 728 may include a graph or function in which a greater age corresponds to a higher usage charge, such as the graph of FIG. 2, and from which usage charges may be calculated based on age. In some embodiments, the application 722 may be arranged to operate with the program data 724 on the OS 720 such that implementations of maintenance-cost-aware billing methods such as the method 600 of FIG. 6 may be provided as described herein. This described basic configuration 702 is illustrated in FIG. 7 by those components within the inner dashed line.

The computing device 700 may have additional features or functionality, and additional interfaces to facilitate communications between the basic configuration 702 and any required devices and interfaces. For example, a bus/interface controller 730 may be used to facilitate communications between the basic configuration 702 and one or more data storage devices 732 via a storage interface bus 734. The data storage devices 732 may be removable storage devices 736, non-removable storage devices 738, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

The system memory 706, removable storage devices 736 and non-removable storage devices 738 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by the computing device 700. Any such computer storage media may be part of the computing device 700.

The computing device 700 may also include an interface bus 740 for facilitating communication from various interface devices (e.g., output devices 742, peripheral interfaces 744, and communication devices 746) to the basic configuration 702 via the bus/interface controller 730. Example output devices 742 include a graphics processing unit 748 and an audio processing unit 750, which may be configured to communicate to various external devices such as a display or speakers via one or more A/V ports 752. Example peripheral interfaces 744 include a serial interface controller 754 or a parallel interface controller 756, which may be configured to communicate with external devices such as input devices (e.g., keyboard, mouse, pen, voice input device, touch input device, etc.) or other peripheral devices (e.g., printer, scanner, etc.) via one or more I/O ports 758. An example communication device 746 includes a network controller 760, which may be arranged to facilitate communications with one or more other computing devices 762 over a network communication link via one or more communication ports 764.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

The computing device 700 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. The computing device 700 may also be implemented as a personal computer including both laptop computer and non-laptop computer configurations.

The present disclosure is not to be limited in terms of the particular embodiments described herein, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that the present disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible sub ranges and combinations of sub ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into sub ranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A method for performing maintenance-cost-aware billing, the method comprising:

generating, by a processor, a version of a virtual machine image; and calculating, by the processor, a usage charge for usage of an instantiated virtual machine corresponding to the version of the virtual machine image based on an age of the version of the virtual machine image.

2. The method of claim 1, further comprising calculating, over the course of a maintenance period of the virtual machine image specified in a contract associated with the virtual machine image, a plurality of usage charges for usage of the instantiated virtual machine corresponding to the version of the virtual machine image, wherein each of the plurality of usage charges is based on a corresponding age of the version of the virtual machine image.

3. The method of claim 2, wherein the plurality of usage charges are configured to be sufficient to completely offset maintenance costs associated with maintaining the version of the virtual machine image over the course of the maintenance period.

4. The method of claim 3, wherein the plurality of usage charges are further configured to be sufficiently large that maintaining the version of the virtual machine image according to the specified maintenance period is profitable.

5. The method of claim 2, further comprising iterating as follows:

automatically migrating to a relatively newer version of the virtual machine image at an end of a current maintenance period;

initiating a new maintenance period; and calculating, over the course of the new maintenance period, a plurality of usage charges for usage of an instantiated virtual machine corresponding to the relatively newer version of the virtual machine image, wherein each of the plurality of usage charges is based on a corresponding age of the relatively newer version of the virtual machine image.

6. The method of claim 5, wherein:

a given relatively newer version of the virtual machine image comprises a latest version of the virtual machine image and a first usage charge calculated at a beginning of a corresponding new maintenance period has a first value; or the given relatively newer version of the virtual machine image comprises a non-latest version of the virtual machine image such that the first usage charge calculated at the beginning of the corresponding new maintenance period has a second value that is higher than the first value.

7. The method of claim 1, wherein the usage charge is calculated according to a function or graph in which a greater age corresponds to a higher usage charge.

8. The method of claim 1, wherein the usage charge is calculated according to an arc tangent function generally of the form $f(x)=A\cdot\arctan(x-B)+\pi(A/2)$, where f(x) is the calculated usage charge in a range including a minimum charge $C_{min}\leq f(x)\leq$a maximum charge $C_{max}$, x is the age of the version of the virtual machine image in a domain including a minimum age $x_{min}\leq x\leq$a maximum age $x_{max}$, and A and B are constants such that $f(x_{min})=C_{min}$ and $f(x_{max})=C_{max}$.

9. A computer storage medium having computer-executable instructions stored thereon that are executable by a computing device to perform operations comprising:

generating a version of a virtual machine image; and calculating a usage charge for usage of an instantiated virtual machine corresponding to the version of the virtual machine image based on an age of the version of the virtual machine image.

10. The computer storage medium of claim 9, further comprising computer executable instructions that are executable by the computing device to perform operations comprising calculating, over the course of a maintenance period of the virtual machine image specified in a contract associated with the virtual machine image, a plurality of usage charges for usage of the instantiated virtual machine corresponding to the version of the virtual machine image, wherein each of the plurality of usage charges is based on a corresponding age of the version of the virtual machine image.

11. The computer storage medium of claim 10, wherein the plurality of usage charges are configured to be sufficient to completely offset maintenance costs associated with maintaining the version of the virtual machine image over the course of the maintenance period.

12. The computer storage medium of claim 10, further comprising computer executable instructions that are executable by the computing device to perform operations comprising iterating as follows:

automatically migrating to a relatively newer version of the virtual machine image at an end of a current maintenance period;

initiating a new maintenance period; and calculating, over the course of the new maintenance period, a plurality of usage charges for usage of an instantiated virtual machine corresponding to the relatively newer version of the virtual machine image, wherein each of the plurality of usage charges is based on a corresponding age of the relatively newer version of the virtual machine image.

13. The computer storage medium of claim 12, wherein:

a given relatively newer version of the virtual machine image comprises a latest version of the virtual machine image and a first usage charge calculated at a beginning of a corresponding new maintenance period has a first value; or the given relatively newer version of the virtual machine image comprises a non-latest version of the virtual machine image such that the first usage charge calculated at the beginning of the corresponding new maintenance period has a second value that is higher than the first value.

14. The computer storage medium of claim 9, wherein the usage charge is calculated according to a function or graph in which a greater age corresponds to a higher usage charge.

15. A back end system of a cloud service, the back end system comprising:

a version controller configured to generate a plurality of versions of a plurality of virtual machine images; and a billing module configured to calculate a plurality of usage charges for usage of a plurality of instantiated virtual machines corresponding to the plurality of versions of the plurality of virtual machine images, wherein a calculation of each of the plurality of usage charges is based on an age of a corresponding version of a corresponding virtual machine image.

16. The back end system of claim 15, further comprising a virtual machine image database configured to store each of the plurality of versions of the plurality of virtual machine images, each being stored according to a corresponding maintenance period specified by a corresponding contract.

17. The back end system of claim 16, further comprising a maintenance database configured to store a plurality of maintenance periods corresponding to the plurality of versions of the plurality of virtual machine images.

18. The back end system of claim 15, wherein the version controller is further configured to migrate each virtual machine image to a newer version of a corresponding virtual machine image according to a corresponding contract by, for each virtual machine image:

determining when the corresponding maintenance period will expire;

determining a particular newer version of the corresponding virtual machine image to which the virtual machine image will be migrated at the end of the corresponding maintenance period;

generating the particular newer version of the corresponding virtual machine image;

determining that the corresponding maintenance period has expired;

initiating a corresponding new maintenance period; and migrating the virtual machine image to the particular newer version of the corresponding virtual machine image.

19. The back end system of claim 18, wherein:

the particular newer version of the corresponding virtual machine image comprises a latest version of the corresponding virtual machine image and a first usage charge calculated at a beginning of the corresponding new maintenance period has a first value; or the particular newer version of the corresponding virtual machine image comprises a non-latest version of the corresponding virtual machine image such that the first usage charge calculated at the beginning of the corresponding new maintenance period has a second value that is higher than the first value.

20. The back end system of claim 15, wherein the billing module is configured to calculate the plurality of usage charges according to a function or graph configured to incentivize early migration to a latest version of each of the plurality of virtual machine images.

* * * * *

UNITED STATES PATENT AND TRADEMARK OFFICE

CERTIFICATE OF CORRECTION

PATENT NO. : 8,554,649 B1
APPLICATION NO. : 13/576383
DATED : October 8, 2013
INVENTOR(S) : Kurabayashi et al.

It is certified that error appears in the above-identified patent and that said Letters Patent is hereby corrected as shown below:

In the Drawings

In Fig. 1, Sheet 1 of 5, delete Tag "200" and insert Tag -- 100 --, therefor, as shown on the attached page 2, sheet 1 of 5.

In the Specification

In Column 4, Line 61, delete "client device 308" and insert -- client device 304 --, therefor.

In Column 9, Line 4, delete "$t_{244}$," and insert -- $t_2$-$t_4$, --, therefor.

In the Claims

In Column 15, Line 50, in Claim 10, delete "computer executable" and insert -- computer-executable --, therefor.

In Column 15, Line 65, in Claim 12, delete "computer executable" and insert -- computer-executable --, therefor.

Signed and Sealed this
Third Day of June, 2014

Michelle K. Lee

Michelle K. Lee
*Deputy Director of the United States Patent and Trademark Office*